US011933111B2

(12) United States Patent
Van Helvoirt

(10) Patent No.: US 11,933,111 B2
(45) Date of Patent: Mar. 19, 2024

(54) THREADED JOINT FOR OIL AND GAS PIPES

(71) Applicant: Tubacex Upstream Technologies S.A., Leioa (ES)

(72) Inventor: Robbert Van Helvoirt, Hertogenbosch (NL)

(73) Assignee: TUBACEX UPSTREAM TECHNOLOGIES S.A. (ES)

( * ) Notice: Subject to any disclaimer, the term of this patent is extended or adjusted under 35 U.S.C. 154(b) by 796 days.

(21) Appl. No.: 16/311,603

(22) PCT Filed: Jun. 20, 2017

(86) PCT No.: PCT/EP2017/065141
§ 371 (c)(1),
(2) Date: Dec. 19, 2018

(87) PCT Pub. No.: WO2017/220614
PCT Pub. Date: Dec. 28, 2017

(65) Prior Publication Data

US 2019/0234154 A1 Aug. 1, 2019

(30) Foreign Application Priority Data

Jun. 21, 2016 (EP) ..... 16382287

(51) Int. Cl.
*E21B 17/042* (2006.01)

(52) U.S. Cl.
CPC ..... *E21B 17/042* (2013.01)

(58) Field of Classification Search
CPC .... E21B 17/042; E21B 17/0423; F16L 15/04; F16L 15/004; F16L 15/009
See application file for complete search history.

(56) References Cited

U.S. PATENT DOCUMENTS 2,992,019 A * 7/1961 MacArthur ..... E21B 17/0423 285/110
3,870,351 A 3/1975 Matsuki
(Continued)

FOREIGN PATENT DOCUMENTS

CA 2921411 A1 3/2015
DE 4446806 C1 5/1996
(Continued)

OTHER PUBLICATIONS

International Search Report and Written Opinion in corresponding International Patent Application No. PCT/EP2017/065141, dated Aug. 25, 2017 (12 pages).

*Primary Examiner* — Matthew Troutman
*Assistant Examiner* — Fannie C Kee
(74) *Attorney, Agent, or Firm* — SNELL & WILMER LLP

(57) ABSTRACT

Threaded joint for oil and gas pipes, including a female part and a male part, the female part being a joint tubular body including a threaded coupling section, a seal section which prolongs the coupling section, the male part including a tubular body which includes a first section which external surface is threaded, a second sealing section including a seal surface which cooperates with the female part seal surface for sealing the joint, the sealing surface of the female part being made of conical sections, the sealing surface of the male part includes a proximal portion closer to the first section and a distal portion, the proximal section portion being a conical surface which forms a first seal with the sealing surface of the female part and the distal portion having a convex surface which forms a second seal with the sealing surface of the female part.

17 Claims, 6 Drawing Sheets

(56) References Cited

U.S. PATENT DOCUMENTS 4,384,737 A * 5/1983 Reusser ..... F16L 15/004 285/334
4,624,488 A * 11/1986 Furgerson ..... E21B 17/0423 285/334
5,649,725 A * 7/1997 Nagasaku ..... E21B 17/042 285/334.4
7,334,821 B2 * 2/2008 Dutilleul ..... E21B 17/042 285/333
7,997,627 B2 * 8/2011 Sugino ..... F16L 15/004 285/333
8,038,179 B2 * 10/2011 Takano ..... F16L 15/004 285/333
8,287,008 B2 * 10/2012 Charvet-Quemin ..... E21B 17/042 285/333
9,194,515 B2 * 11/2015 Oshima ..... E21B 17/08
9,719,617 B2 * 8/2017 Okada ..... E21B 17/042
10,316,995 B2 * 6/2019 Gillot ..... F16L 15/004
10,697,251 B2 * 6/2020 Juarez ..... E21B 17/0423
2010/0270793 A1 10/2010 Takano et al.
2011/0241340 A1 10/2011 Okada et al.
2014/0070526 A1 * 3/2014 Pallini, Jr. ..... F16L 15/004 285/80
2015/0001841 A1 1/2015 Oshima et al.
2015/0145247 A1 * 5/2015 Zhu ..... E21B 17/042 285/333
2016/0319966 A1 * 11/2016 Kawai ..... E21B 17/042
2019/0056049 A1 * 2/2019 Kawai ..... F16L 15/04

FOREIGN PATENT DOCUMENTS

WO 2004079246 A1 9/2004
WO 2004109173 A1 12/2004
WO 2009083523 A1 7/2009
WO 2010047406 A1 4/2010
WO WO-2015077464 A2 * 5/2015 ..... E21B 17/042

* cited by examiner

THREADED JOINT FOR OIL AND GAS PIPES

CROSS-REFERENCE TO RELATED APPLICATIONS

This application is a National Stage Entry of PCT/EP2017/065141, filed Jun. 20, 2017, which claims priority to European Patent Application No. 16382287.7, filed Jun. 21, 2016, the contents of each of which are hereby incorporated by reference in their entireties.

TECHNICAL FIELD

The present invention relates to threaded joints for oil and gas pipes, of the type comprising a threaded female part and a male threaded part, for example a pin and box or premium connection, specially designed for operating in severe conditions, both in external and internal pressure terms, and which are better known as premium joints.

STATE OF THE ART

Premium joints comprise a pin and a box provided with tapered threads which allow fastening them by providing a seal surface in mutually cooperating tapered surfaces where a seal is created and which comprise a pin nose abutting on a shoulder of the box which acts as a stopper in the connection.

The seal is formed by a metal-to-metal intimate contact that has to withstand both external and internal pressures, axial loads and bending.

WO 2004/109173, US 2011/0241340 and US 2015/0001841 disclose the main features of these premium joints.

The details of the coupling, particularly the design of the surfaces that create the seal during the connection, is critical, because it must guarantee a total tightness in all conditions, namely internal and external pressure, tension and compression, bending and all of them at all operational temperatures.

For this reason, the more recent documents describe very specific solutions based on different designs of the surfaces of the pin and the box to create a seal.

US 2011/0241340 describes several solutions based on cone to cone joints and unions based on a rounded section in one of the parts, pin or box, and cylindrical in the other one. In FIGS. 3A to 3D of this document contours of the sealing surface of the box formed by alternating conical and curved surfaces are described. In FIGS. 4 and 5 the resulting sealing joints are shown. All these combinations are intended to form a single joint, destined to withstand on its proximal and distal sides the external pressure and the internal pressure respectively. In the context of the present invention, distal refers to the parts that are closest to the pin nose (or the shoulder) and proximal refers to those who are farthest from the pin nose, i.e. those parts that are closer to the thread.

Premium joints comprising two sealing surfaces instead of one have been disclosed too.

Some of these solutions have one of the seals in the tapered zone of the pin and the box and another seal in the longitudinal bearing surface, i.e. in the shoulder/pin nose region.

Other double seal solutions have both seals in the tapered regions, solutions in which the shoulder area has only a support function. The present invention belongs to this sort of solutions.

An example of these double seals is described in DE4446806C1, which is considered the closest prior art for the present invention.

In particular in FIG. 1 of DE4446806C1 a double seal based on two rounded sections to cone surface is shown. FIG. 3 shows another double seal, wherein the proximal seal is a rounded section to cone seal and the distal seal is a cone to cone seal.

While the seal is guaranteed in two zones, it is not an optimal solution, since the two seals are identical and do not consider that they are facing different conditions. The distal seal is intended to ensure sealing against internal pressure, while the proximal seal is designed to ensure tightness against external pressures. A major difference in the effect of the internal and the external pressure is that the internal pressure improves the sealing, since it tends to expand the pin nose, that is, it has a self-sealing effect.

Moreover, if the two seals are of the same type, and it is desired to increase tightness on one side with respect to the other one, this may ensure an adequate tightness but one of the seals will be overstressed, condition that may accelerate the galling of the contact surfaces, which is another process to avoid.

Another aspect not optimal in the prior art solutions is that the coupling process must ensure an effective coupling and the correct formation of the double seal in all the joints of the entire pipe. The coupling process involves a relative displacement between pin and box whose outcome may depend on the conditions under which the coupling is performed.

The present invention also aims to ensure that the seals are formed in a short relative course between pin and box and that the stress profiles are identical for different joints.

DESCRIPTION OF THE INVENTION

For overcoming the state of the art drawbacks, the present invention proposes a threaded joint for oil or gas pipes, the joint comprising a female part and a male part, wherein a coupling direction between the male part and the female part and a coupling configuration are defined, wherein the female part is a joint tubular body comprising a coupling section which internal surface is threaded, a seal section which prolongs the coupling section in the coupling direction with a decreasing diameter in the coupling direction, the seal section having an internal sealing surface and a shoulder at the end of the seal section for bearing an end of the male part in the coupling configuration and wherein the male part comprises a tubular body which comprises a first section which external surface is threaded and which is complementary to the threaded internal surface of the female part, a second sealing section comprising a seal surface which in the coupling configuration cooperates with the seal surface of the female part for sealing the joint, and wherein:

- the internal sealing surface of the female part is made of conical sections;
- the seal surface of the male part comprises two portions, a proximal portion closer to the first section and a distal portion closer to the male part end;
- the proximal section portion being a conical surface which forms, in the coupling configuration, a first seal with the sealing surface of the female part;
- the distal portion having a convex surface which forms, in the coupling configuration, a second seal with the sealing surface of the female part.

Throughout the description, the proximal seal means the seal closest to the thread, and the distal seal means the seal that is arranged closer to the shoulder.

This arrangement provides good sealing capacities during assembly as the contact stresses complement each other providing optimum seal contact length when fully made up. The stresses around the conical seal during initial contact to the sealing position increase at much higher rate when compared to stresses at the convex surface.

In particular, this configuration provides an asymmetrical configuration of a double seal arrangement, which in turn provides for withstanding both the external pressure and the internal pressure, the external pressure being the pressure coming from the gap between the threads, the internal pressure being the pressure coming from the interior of the pipe/duct.

It is known that the connections ability to seal for various conditions is a function of seal stress and contact length. The combination of low contact area/high stress (conical) and high contact area/low stress (toroidal) during make up reduces the risk of galling whilst providing sufficient strain energy in each seal for the various loading combinations. The peak conical stress resulting from the cone-cone seal prevents ingress from external pressure whilst the design reduces the risk of loads induced from the wedge effect. The seal design and location also provides maximum strain energy during the most difficult combinations such as tension with external pressure.

There is no need for high convex seal stress because the internal pressure assists the sealing contact pressures. Although the stresses at the convex or toroidal seal are considerably lower when compared to the conical seal the seal contact pressures are assisted by internal pressure acting on the male part end.

Therefore, the seal design stress concentrations, contact area and locations are optimized to withstand galling and for any load conditions.

In some embodiments, the aperture angle of the conical surface of the proximal section portion of the male part and the aperture angle of the proximal conical section of the female part are different.

In some embodiments, the angle of the conical surface of the proximal section portion is greater than the angle of the proximal conical section of the female part.

Other embodiments include arrangements wherein the angle of the conical surface of the proximal section portion is lower than the angle of the proximal conical section of the female part.

In some particular embodiments, the angle formed by the generatrix and the axis of the cone section of the female part is comprised between 10° and 20° and the angle formed by the generatrix and the axis of the cone section of the proximal section of the male part is comprised between 10° and 20°.

In some embodiments, the conical sections of the sealing surface of the female part belong to the same cone, and therefore have the same angle.

In some embodiments, the conical sections of the sealing surface of the female part have a different angle.

In some embodiments, the convex surface is a toroid section and preferably the radius of a circle which generates the toroid section is comprised between 45 and 70 cm, and is preferably of 50 cm.

The invention also relates to a threaded joint for oil and gas pipes, the joint comprising a female part and a pin, wherein a coupling direction between the male part and the female part and a coupling configuration are defined, wherein the female part is a joint tubular body comprising a coupling section which internal surface is threaded, a seal section which prolongs the coupling section in the coupling direction with a decreasing diameter in the coupling direction, the seal section having an internal sealing surface and a shoulder at the end of the seal section for bearing a end of the male part in the coupling configuration and wherein the male part comprises a tubular body which comprises a first section which external surface is threaded and which is complementary to the threaded internal surface of the female part, a second sealing section comprising a seal surface which in the coupling configuration cooperates with the seal surface of the female part for sealing the joint, and wherein:

- the seal surface of the male part is made of a proximal conical section closer to the thread, and a distal section closer to the male part end;
- the internal sealing surface of the female part comprises two portions, a proximal section portion closer to the thread and a distal section portion closer to the shoulder;
- the proximal section portion of the female part being a conical surface which forms, in the coupling configuration, a first seal with the proximal conical section of the pin;
- the distal section portion having a convex surface which forms, in the coupling configuration, a second seal with the distal section of the pin.

It is a second alternative to the configuration described above, but wherein the convex surface has a reversed position, which is now in the female part instead of the pin. The advantages are the same as for the inventive concept described above.

In some embodiments of this second alternative:

- the angle of the conical surface of the proximal conical section of the male part and the angle of the proximal section portion of the female part are different and preferably the angle of the conical surface of the proximal section portion of the female part is greater than the angle of the proximal conical section of the pin; or
- the conical sections of the sealing surface of the male part belong to the same cone.

For all the embodiments disclosed, it is preferred that the shoulder has a rounded section, the convex surface belonging to the pin. Due to machining reasons a straight negative shoulder angle could be considered as well.

With a shoulder with a rounded section or a negative straight section or a step, the male part is better supported during external pressure.

In some embodiments, the nose comprises an annular recess in the seal surface for storing a lubricant, the recess being located between the proximal section and the distal portion.

The invention can be applied to both dry and wet joints. In the latter case a lubricant is placed between the surfaces in contact. According to the invention two metal-to-metal seals are established and when the coupling is carried out, it may occur in the case of wet joints, that in the establishment of the first seal too much lubricant is drawn forward, leaving little quantity for the second seal. This effect can be mitigated by the annular recess.

Finally, in specially preferred embodiments, the female part and the male part are respectively the box and the pin of a premium connection. In other embodiments, the male and the female parts belong to a flush type connection.

BRIEF DESCRIPTION OF THE DRAWINGS

To complete the description and in order to provide for a better understanding of the invention, a set of drawings is provided. Said drawings form an integral part of the description and illustrate an embodiment of the invention, which should not be interpreted as restricting the scope of the invention, but just as an example of how the inventive joint can be carried out. The drawings comprise the following figures.

DESCRIPTION OF A WAY OF CARRYING OUT THE INVENTION

Figure 1:
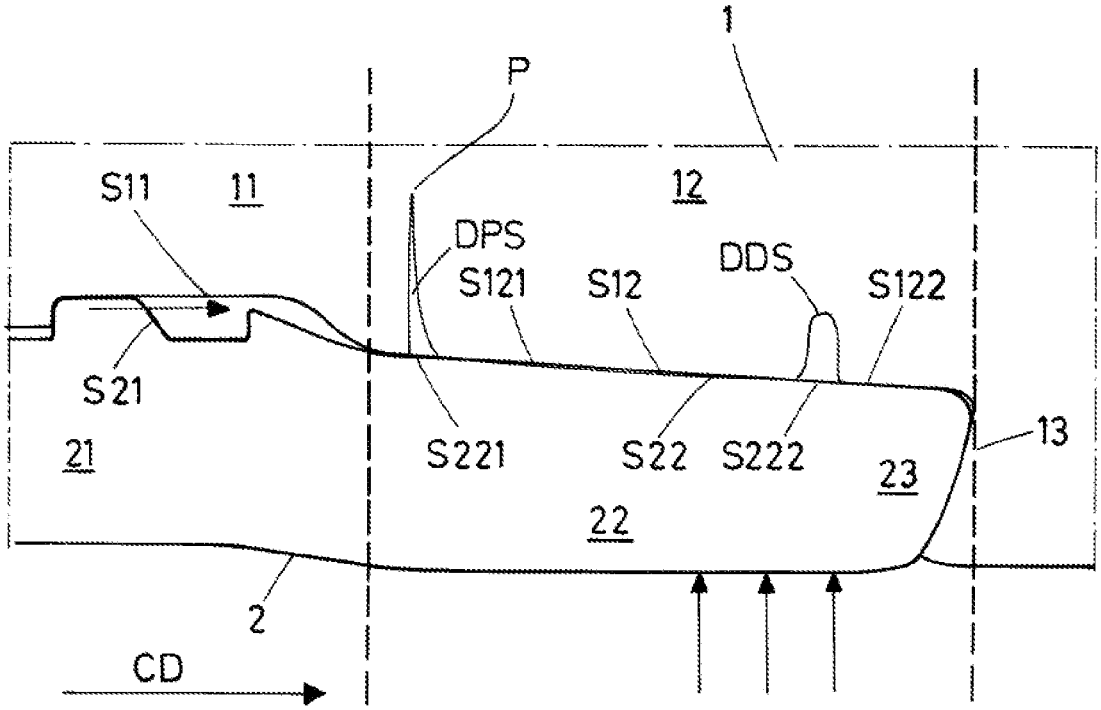
FIG. 1 is a section showing the different parts of the inventive premium connection according to a preferred embodiment.

As shown in FIG. 1, and according to a preferred embodiment the present invention relates to a threaded joint for oil and gas pipes which comprises a box 1 and a pin 2. Although in the present section reference is made to a pin and box joint, the invention can obviously be applied to a flush joint, that is, a joint where one end a pipe element comprises a threaded female part, whereas the other end comprises a threaded male part, such that it can be screwed in the next element.

A coupling direction CD between the pin 2 and the box 1 and a coupling configuration are defined. The coupling configuration is shown in FIG. 1 to FIG. 5 and in FIG. 6*h*. The other figures show the coupling course.

The box 1 is a joint tubular body comprising a coupling section 11 which internal surface S11 is threaded.

A seal section 12 prolongs the coupling section 11 in the coupling direction. This seal section 12 has a decreasing diameter in the coupling direction.

The seal section 12 has an internal sealing surface S12 and a shoulder 13 at the end of the seal section 12 for bearing a nose 23 (or end) of the pin 2 in the coupling configuration.

The pin 2 comprises a tubular body which comprises a first section 21 which external surface S21 is threaded and which is complementary to the threaded internal sealing surface S11 of the box 1 and a second sealing section 22 comprising a seal surface S22 which in the coupling configuration cooperates with the internal sealing surface S12 of the box 1 for sealing the joint.

Figure 6A:
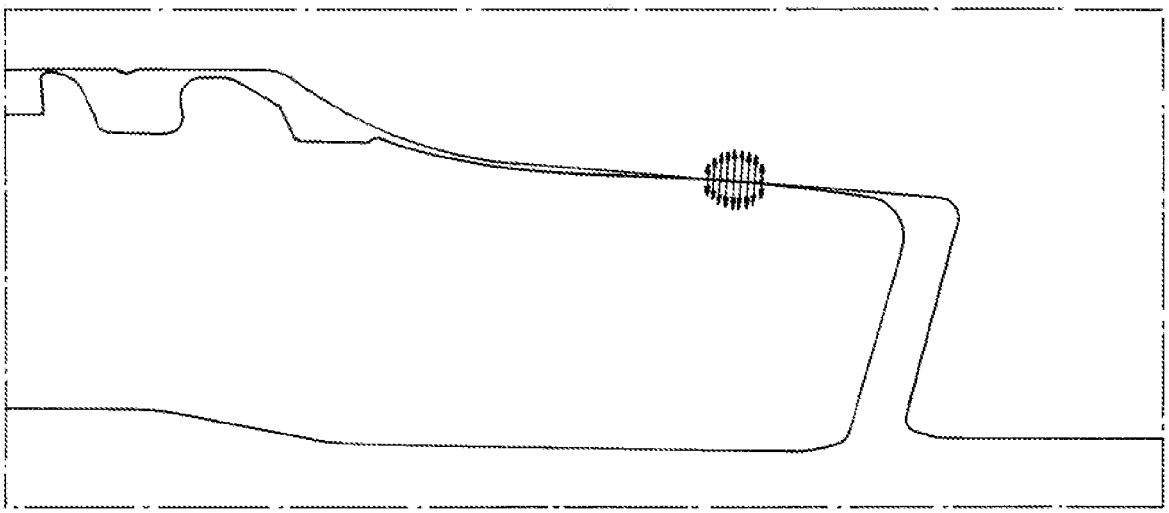
FIGS. 6*a* to 6*h* show how the seals are approximately behaving during make-up of the premium connection.
Figure 6B:
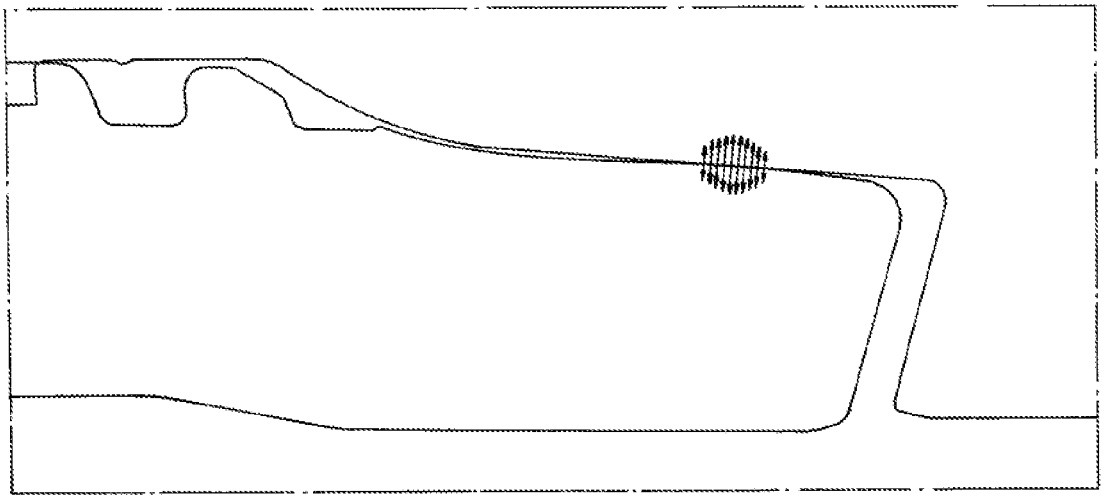
Figure 6C:
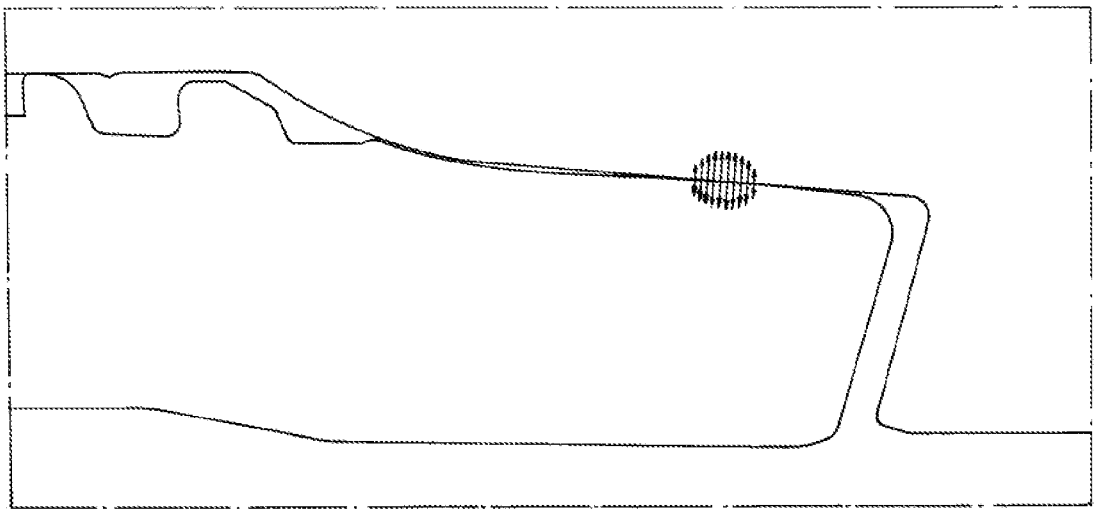
Figure 6D:
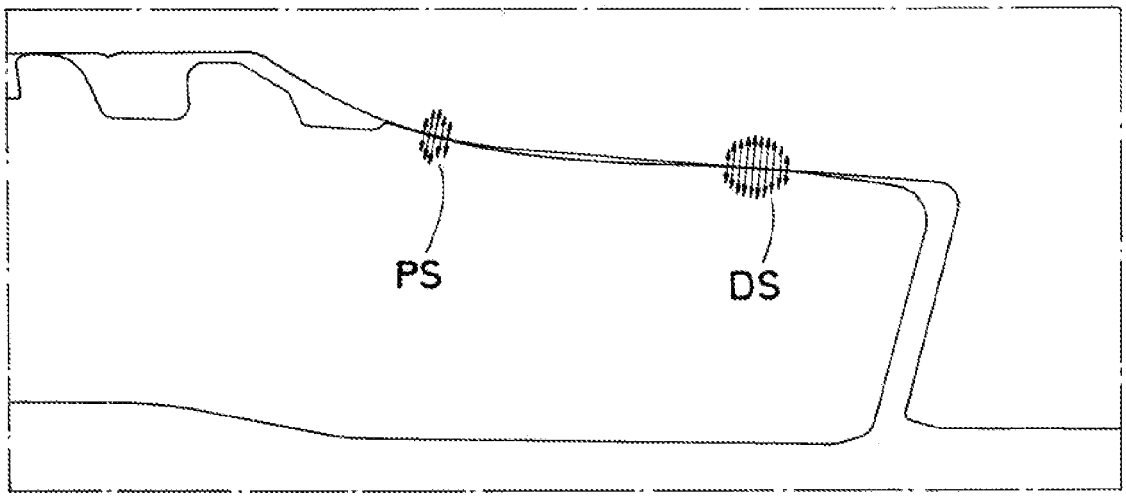
Figure 6E:
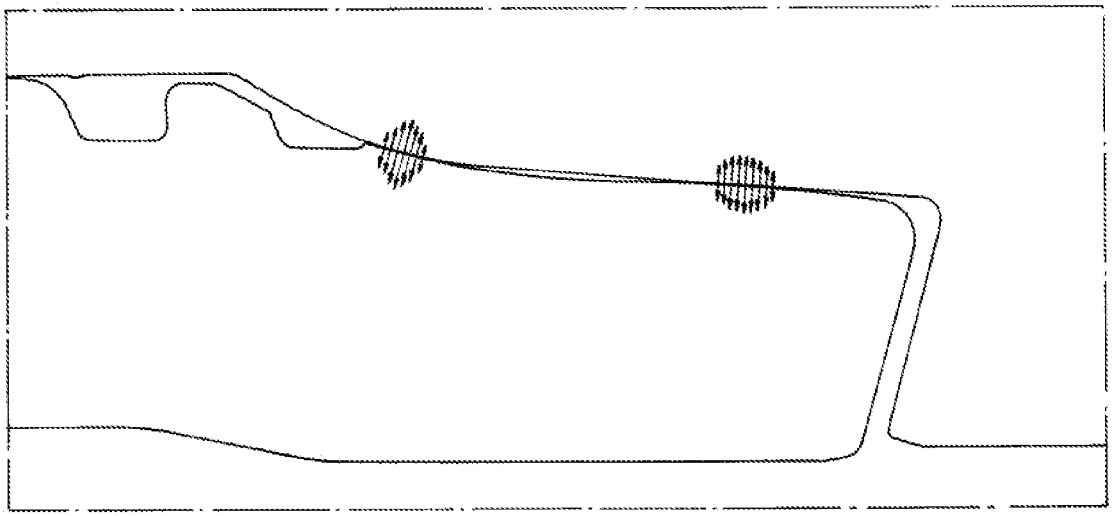
Figure 6F:
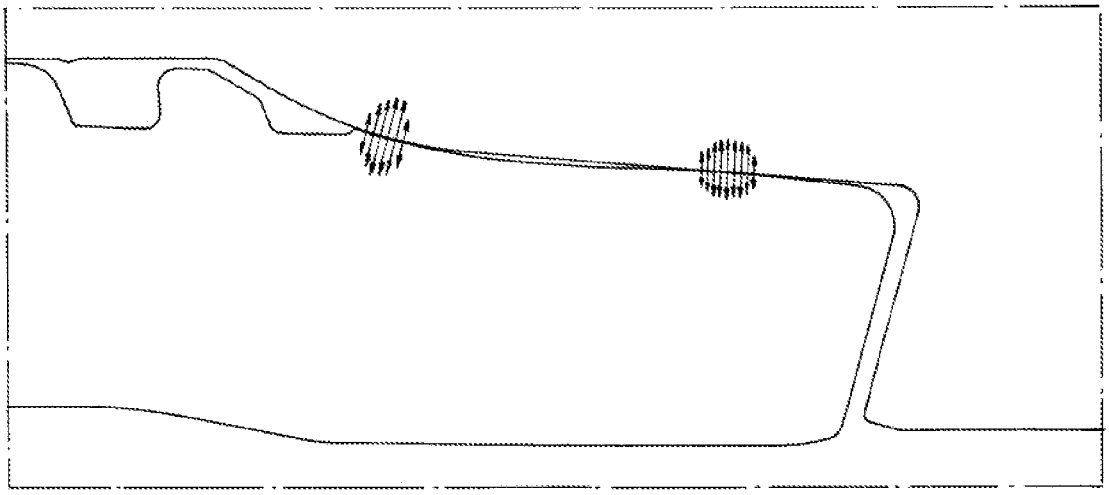
Figure 6G:
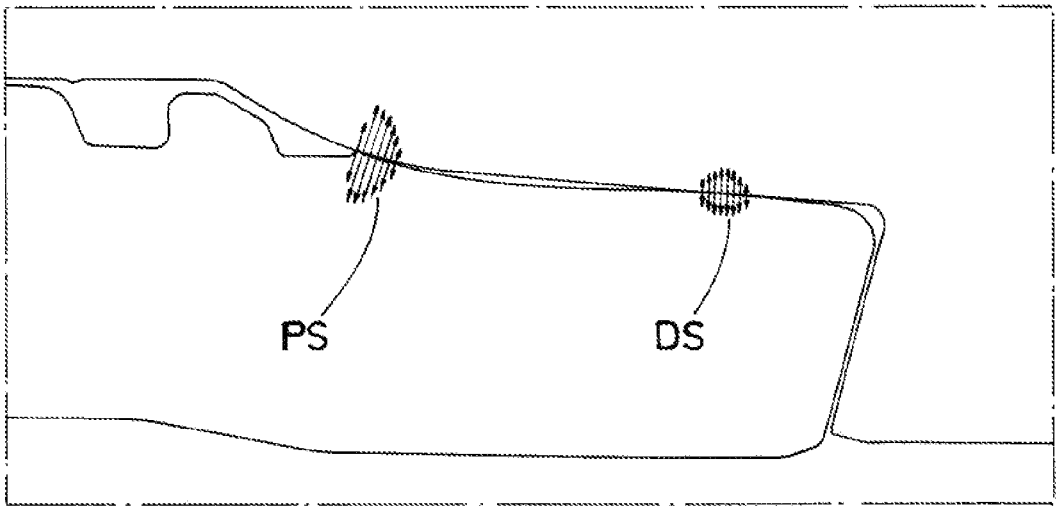

According to the invention:

- the internal sealing surface S12 of the box 1 is made of conical sections S121, S122;
- the seal surface S22 of the pin 2 comprises two portions S221, S222, a proximal portion S221 closer to the first section 21 and a distal portion S222 closer to the nose 23;
- the proximal portion S221 is a conical surface which forms, in the coupling configuration, a first seal PS (see FIG. 6*g*) with the internal sealing surface S12 of the box 1; and
- the distal portion S222 has a convex surface S223 which forms, in the coupling configuration, a second seal DS (see FIG. 6*g*) with the internal sealing surface S12 of the box 1.

Figure 2:
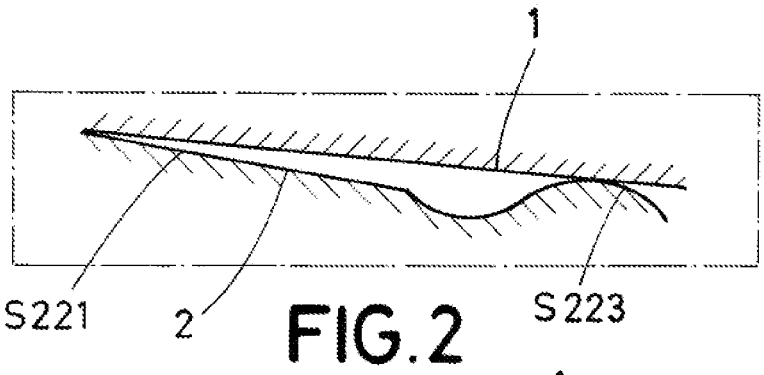
FIG. 2 shows very schematically the double seal connection according to the most preferred embodiment.

As shown in FIG. 1, 2 and FIGS. 6*a* to 6*h* and according to a preferred embodiment, the angle of the conical surface of the proximal portion S221 of the pin is greater than the angle of the proximal conical section S121 of the box. Also it can be seen that according to this preferred embodiment the cone surfaces S121, S122 of the box 2 have the same angles. This is also shown in the sketch of FIG. 2, which relative dimensions have been exaggerated to show the qualitative geometric aspects of the seals PS, DS.

Figure 6H:
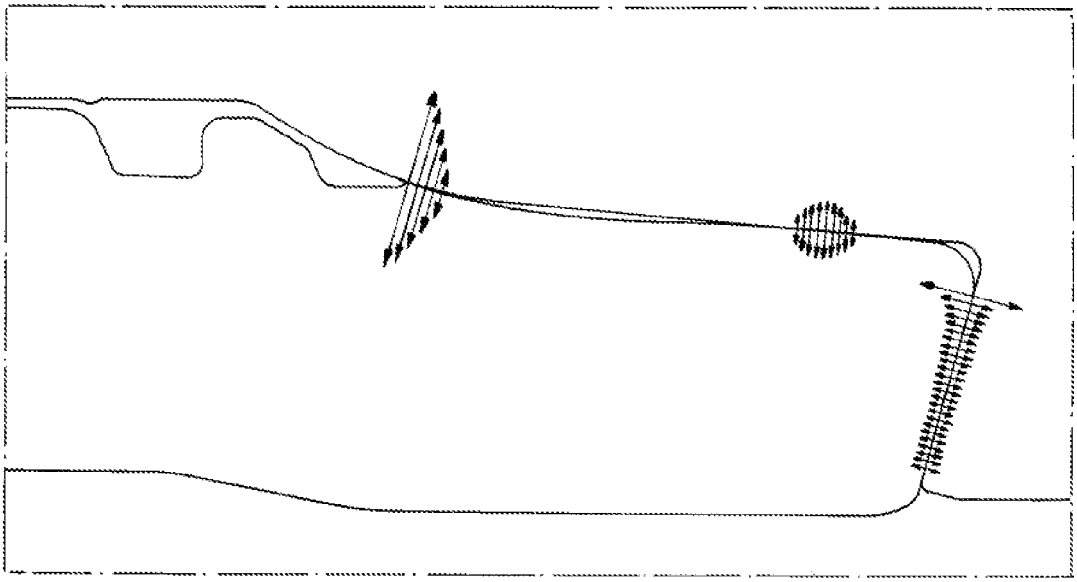

FIG. 1 also shows the spatial stress profile of the seals. The stress profile is the function representing the stress vs the position along the line that generates the sealing surface. The stress profile of the proximal seal has the reference DPS, and the stress profile of the distal seal has the reference DDS. The proximal seal has a peak P adjacent to the thread zone, this peak P being a maximum in the stress profile (see FIG. 1), and therefore serves as a barrier for withstanding external pressures, whereas the distal seal is symmetrical and has a lower maximum pressure. FIG. 6*h* further shows the stress profile created in the shoulder 13, 23.

In the embodiments shown, the angle formed by the generatrix and the axis of the cone section of the box is comprised between 10° and 20° and the angle formed by the generatrix and the axis of the cone section of the proximal portion S221 of the pin 2 is comprised between 10° and 20°.

Now some particular cases will be disclosed with reference to FIGS. 2 to 5.

The conical section of the box is a single tapered zone

In this case, shown in FIG. 1, the conical sections S121, S122 of the internal sealing surface S12 of the box 1 belong to the same cone, and therefore have the same angle.

Having a single tapered zone in the box involves two major advantages.

Manufacturing is fairly simple.

The gauging of the box tapered zone is simple.

The box has two different tapered zones with different angles

Figure 4:
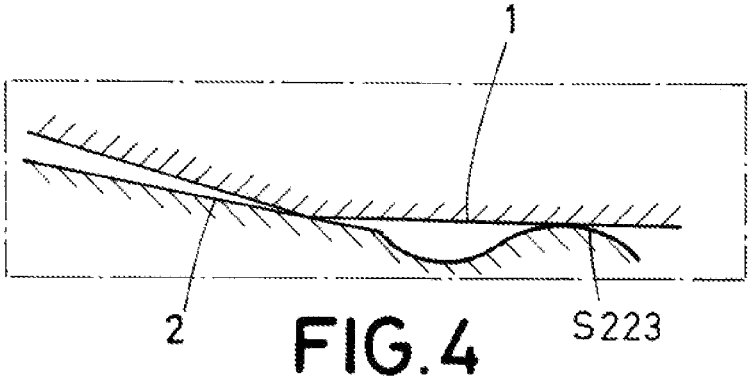
FIGS. 4 and 5 show embodiments wherein the part, pin or box, having conical surfaces have two different sections with different cone apertures.

In this case, shown in FIG. 4, the conical sections S121, S122 of the sealing surface S12 of the box 1 have a different angle.

With the use of 2 different angles, there can be a better optimization of the seal contact area and contact pressure.

The convex surface is located in the box instead of the pin

Figure 3:
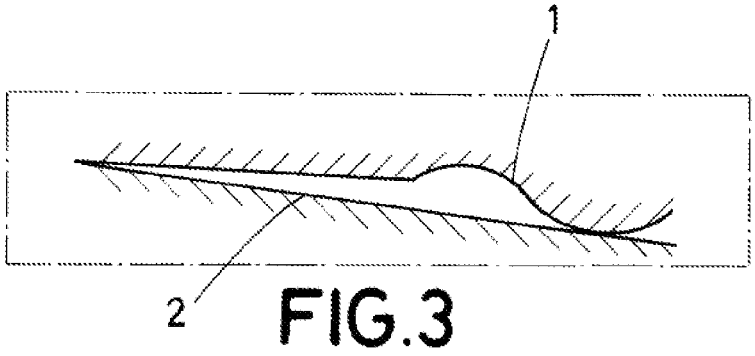
FIG. 3 shows an embodiment wherein the rounded surface is placed in the box and wherein all the pin seal surfaces are conical.
Figure 5:
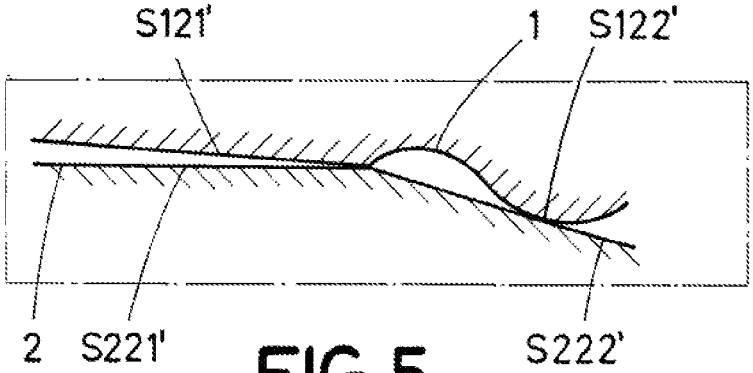

As shown in FIGS. 3 and 5, other embodiments consist in swapping the location of the convex/toroidal surface between the pin 2 and the box 1. Although these alternatives are minor from a fabrication point of view, the effect of the location of two different seals is the same that in the preferred embodiment disclosed above.

Simulation of the Buildup of the Seals

Now the manner in which the seals are formed in the coupling process will be described with reference to FIGS. 6*a* to 6*h*. The advantageous effects provided by the features according to the preferred embodiment will be described as well.

In particular, these figures show the stress profiles formed in the two substantially annular bands constituting the proximal seal PS, i.e. the seal closest to the thread, and the distal seal DS, i.e. the seal that is arranged closer to the shoulder 13, 23.

At the time of the first contact between pin 2 and box 1, the distal seal DS begins to form. As shown, the reaction stresses that appear between the convex curved surface S223 of the pin nose 23 and the distal (tapered) surface S122 of the box 1 create a stress profile which is symmetrical along an axis substantially perpendicular to the contact surface. As can be seen along the entire coupling course, this profile is very stable and keeps both its magnitude and its symmetry during the introduction.

However, the cone-cone contact corresponding to the proximal seal has a different evolution and a different profile than those of the distal seal DS. In particular, the proximal seal only shows up from the moment shown in FIG. 6*d*.

It is pointed out that FIGS. 6*a* to 6*h* are successive positions at approximately regular intervals.

The rise of the stresses in the proximal seal is due to the cone-cone contact and to the fact that the contact surfaces of the pin 2 and the box 1 are inclined relative to the axis of introduction, i.e. the traveling direction of the surfaces.

At the end of the process of forming the proximal seal PS, it can be appreciated that the stress diagram as a function of the position is biased towards the thread, that is, the diagram is asymmetrical, the major stresses being greater in the thread side, where the pressures tend to be greater.

Therefore, the asymmetry provided by the invention allows to concentrate the high stresses where they are needed, thus providing a better tightness and reduced galling during make up with respect to the prior art solutions.

Moreover, the diagrams stress show that the simultaneous achievement of the two seals is easy to control, because one of them is formed throughout the introduction course with little variation, while the other, the proximal seal PS, is formed in an interval which necessarily overlaps with the formation of the distal seal DS, and which peak is created when the pin nose abuts on the shoulder.

Finally, it has to be pointed out that in spite of the built-up displacement being very short, the displacement caused by a traction in the uncoupling direction can be made even shorter by adjusting correctly the thread tolerances, thus ensuring that under all loading conditions both seals will be effective.

In an embodiment of the threaded joint for oil pipes, the joint comprises a female part 1 and a male part 2, wherein a coupling direction between the male part 2 and the female part 1 and a coupling configuration are defined, the male part having a nose 23, wherein the female part 1 is a joint tubular body comprising a coupling section 11 which internal surface S11 is threaded, the axis of the tubular body having the coupling direction CD, a seal section 12 which prolongs the coupling section 11 in the coupling direction with a decreasing diameter in the coupling direction, the seal section 12 having an internal sealing surface S12 and a shoulder 13 at the end of the seal section 12 for abutting the nose 23 of the male part 2 in the coupling configuration and wherein the male part 2 comprises a tubular body which comprises a first section 21 which external surface S21 is threaded and which is complementary to the threaded internal surface S11 of the female part 1, a second sealing section 22 comprising a seal surface S22 which in the coupling configuration cooperates with the seal surface S12 of the female part 2 for sealing the joint, the nose 23 which in the coupling configuration abuts on the shoulder 13, wherein

- the seal surface S22 of the male part 2 is made of a proximal conical section S221' closer to the thread, and a distal section S222' closer to the male part nose 23;
- the internal sealing surface S12 of the female part 1 comprises a proximal section portion S121' closer to the thread and a distal section portion S122' closer to the shoulder 13;
- the proximal section portion S121' of the female part 1 being a conical surface which forms, in the coupling configuration, a first seal with the proximal conical section S221' of the male part 2;
- the distal section portion of the female part S122' having a convex surface S223 which forms, in the coupling configuration, a second seal DS with the distal section S222' of the male part 2.

In this text, the term "comprises" and its derivations (such as "comprising", etc.) should not be understood in an excluding sense, that is, these terms should not be interpreted as excluding the possibility that what is described and defined may include further elements, steps, etc.

The invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

The invention claimed is:

1. Threaded joint for oil and gas pipes, the joint comprising a female part and a male part, wherein a coupling direction between the male part and the female part and a coupling configuration are defined, the male part having a nose, wherein the female part is a joint tubular body comprising a coupling section which internal surface is threaded, an axis of the tubular body having the coupling direction, a seal section which prolongs the coupling section in the coupling direction with a decreasing diameter in the coupling direction, the seal section having an internal sealing surface and a shoulder at an end of the seal section for abutting the nose of the male part in the coupling configuration and wherein the male part comprises a tubular body which comprises a first section which external surface is threaded and which is complementary to the threaded internal surface of the female part, a second sealing section comprising a seal surface which in the coupling configuration cooperates with the seal surface of the female part for sealing the joint, wherein

- the internal sealing surface of the female part is made of conical sections;
- the seal surface of the male part comprises a proximal portion closer to the first section and a distal portion closer to the end;
- the proximal portion having a conical surface which forms, in the coupling configuration, a first seal with one of the conical sections of the internal sealing surface of the female part, the proximal portion and the internal sealing surface having different cone angles;
- the distal portion having a convex surface which forms, in the coupling configuration, a second seal with the other conical section of the internal sealing surface of the female part;
- such that in the coupling configuration a double seal formed by the first seal and the second seal is established, the first seal being a cone to cone seal that can prevent ingress from external pressure, the second seal being a convex to cone seal.

2. Threaded joint according to claim 1, wherein an aperture angle of the conical surface of the proximal portion of the male part and an aperture angle of a proximal conical section of the female part are different.

3. Threaded joint according to claim 2, wherein the angle of the conical surface of the proximal portion is greater than the angle of the proximal conical section of the female part.

4. Threaded joint according to claim 3, wherein an angle formed by the generatrix and an axis of the cone section of the female part is comprised between and 20° and an angle formed by the generatrix and an axis of the cone section of the proximal portion of the male part is comprised between 10° and 20°.

5. Threaded joint according to claim 1, wherein the conical sections of the sealing surface of the female part belong to the same cone.

6. Threaded joint according to claim 1, wherein the conical sections of the sealing surface of the female part have a different angle.

7. Threaded joint for oil and gas pipes according to claim 1, wherein the convex surface is a toroid section.

8. Threaded joint according to claim 7, wherein a radius of a circle which generates the toroid section is comprised between 45 and 70 cm.

9. Threaded joint according to claim 8, wherein the radius of a circle which generates the toroid section is 50 cm.

10. Threaded joint for oil pipes, the joint comprising a female part and a male part, wherein a coupling direction between the male part and the female part and a coupling configuration are defined, the male part having a nose, wherein the female part is a joint tubular body comprising a coupling section which internal surface is threaded, an axis of the tubular body having the coupling direction, a seal section which prolongs the coupling section in the coupling direction with a decreasing diameter in the coupling direction, the seal section having an internal sealing surface and a shoulder at the end of the seal section for abutting the nose of the male part in the coupling configuration and wherein the male part comprises a tubular body which comprises a first section which external surface is threaded and which is complementary to the threaded internal surface of the female part, a second sealing section comprising a seal surface which in the coupling configuration cooperates with the seal surface of the female part for sealing the joint, the nose which in the coupling configuration abuts on the shoulder, wherein the seal surface of the male part is made of a proximal conical section closer to the thread, and a distal section closer to the male part nose;

the internal sealing surface of the female part comprises a proximal section portion closer to the thread and a distal section portion closer to the shoulder;

the proximal section portion of the female part being a conical surface which forms, in the coupling configuration, a first seal with the proximal conical section of the male part, the proximal section portion and the proximal conical section having different cone angles;

the distal section portion of the female part having a convex surface which forms, in the coupling configuration, a second seal with the distal section of the male part;

such that in the coupling configuration a double seal formed by the first seal and the second seal is established, the first seal being a cone to cone seal that can prevent ingress from external pressure, the second seal being a convex to cone seal.

11. Threaded joint according to claim 10, wherein an angle of the conical surface of the proximal conical section of the male part and an angle of the proximal section portion of the female part are different.

12. Threaded joint according to claim 11, wherein the angle of the conical surface of the proximal section portion of the female part is greater than the angle of the proximal conical section of the male part.

13. Threaded joint according to claim 10, wherein the conical sections of the sealing surface of the male part belong to the same cone.

14. Threaded joint according to claim 10, wherein the convex surface is a toroid section.

15. Threaded joint according to claim 1 or claim 10, wherein the shoulder has a rounded section or a straight section.

16. Threaded joint according to claim 1 or claim 10, wherein the female part and the male part are respectively the box and the pin of a premium connection.

17. Oil or gas pipe comprising joints according to claim 1 or claim 10.

* * * * *